US007984732B2

(12) United States Patent
Sugiyama et al.

(10) Patent No.: US 7,984,732 B2
(45) Date of Patent: Jul. 26, 2011

(54) HEALD FRAME

(75) Inventors: Hiromasa Sugiyama, Aichi-ken (JP); Masanobu Sakai, Aichi-ken (JP)

(73) Assignee: Kabushiki Kaisha Toyota Jidoshokki, Aichi-Ken (JP)

( * ) Notice: Subject to any disclaimer, the term of this patent is extended or adjusted under 35 U.S.C. 154(b) by 0 days.

(21) Appl. No.: 12/629,439

(22) Filed: Dec. 2, 2009

(65) Prior Publication Data

US 2010/0139803 A1 Jun. 10, 2010

(30) Foreign Application Priority Data

Dec. 8, 2008 (JP) ..... 2008-311955

(51) Int. Cl.
*D03C 9/04* (2006.01)
*D03C 9/06* (2006.01)
*D03C 9/00* (2006.01)

(52) U.S. Cl. ..... 139/55.1; 139/35; 139/53; 139/96; 139/455

(58) Field of Classification Search ..... 139/35, 139/55.1, 52, 53, 82–96, 455
See application file for complete search history.

(56) References Cited

U.S. PATENT DOCUMENTS

| | | | | |
|---|---|---|---|---|
| 2,204,891 | A * | 6/1940 | Hamilton | 139/55.1 |
| 4,072,175 | A * | 2/1978 | Buran et al. | 139/455 |
| 4,366,843 | A * | 1/1983 | Shimizu | 139/91 |
| 4,593,723 | A * | 6/1986 | Griffith | 139/65 |
| 4,667,704 | A * | 5/1987 | Griffith | 139/65 |
| 5,040,571 | A * | 8/1991 | Klocker et al. | 139/52 |
| 5,095,952 | A * | 3/1992 | Cheng | 139/65 |
| 5,125,435 | A * | 6/1992 | Froment | 139/455 |
| 5,133,389 | A * | 7/1992 | Griffith | 139/455 |
| 5,176,186 | A * | 1/1993 | Bousfield et al. | 139/455 |
| 5,365,979 | A * | 11/1994 | Yoshida | 139/66 R |
| 6,073,662 | A * | 6/2000 | Herbepin et al. | 139/455 |
| 6,079,455 | A * | 6/2000 | Speich et al. | 139/455 |
| 6,102,080 | A * | 8/2000 | Hockemeyer et al. | 139/52 |
| 6,116,291 | A * | 9/2000 | Hockemeyer et al. | 139/51 |
| 6,955,191 | B2 * | 10/2005 | Hockemeyer et al. | 139/52 |
| 7,185,679 | B2 * | 3/2007 | Schwemmlein et al. | 139/93 |
| 2004/0108012 | A1 * | 6/2004 | Hockemeyer et al. | 139/11 |
| 2005/0284532 | A1 * | 12/2005 | Schwemmlein et al. | 139/55.1 |
| 2007/0079887 | A1 * | 4/2007 | Korbutt et al. | 139/93 |

FOREIGN PATENT DOCUMENTS

| | | |
|---|---|---|
| GB | 2043123 | 10/1980 |
| JP | 10072736 | 3/1998 |
| JP | 11-36154 | 2/1999 |

OTHER PUBLICATIONS

English language Abstract of JP 11-36154, Feb. 9, 1999.

* cited by examiner

*Primary Examiner* — Bobby H Muromoto, Jr.
(74) *Attorney, Agent, or Firm* — Greenblum & Bernstein, P.L.C.

(57) ABSTRACT

A heald frame has a frame stave, a carrier rod provided along the frame stave and a heald made of a resin material. A plurality of healds are supported by the carrier rod and arranged in a row. A magnet having N and S poles is provided in each heald and the healds are arranged so that the adjacent ends of any two adjacent magnets are of the same polarity.

6 Claims, 5 Drawing Sheets

HEALD FRAME

BACKGROUND OF THE INVENTION

The present invention relates generally to a heald frame of a loom, which performs a shedding operation so as to form a shed by moving warp yarns in vertical direction determining a weave pattern, and specifically to a heald frame having healds that are made of a resin material.

Healds of a heald frame are supported by and between a pair of upper and lower carrier rods extending in parallel to each other. Each heald has formed therethrough at the opposite ends thereof holes through which the respective carrier rods are passed. The heald is slidably movable along the carrier rods. Efforts have been made for reducing the weight of healds so as to meet the recent requirements of high-speed loom operation, energy saving and noise reduction. For example, the weight reduction has been accomplished by changing the material of the heald from metal to resin.

Japanese Patent Application Publication H11-36154 discloses a heald frame with healds wherein the healds are made of a magnetic material and magnets are provided in upper and lower frame staves respectively with the N and S poles of the magnets located facing the front and rear sides of the heald frame. The opposite ends of each heald made of a magnetic material that are located adjacent to the magnets are magnetized by the magnets. The healds supported and arranged in a row by upper and lower carrier rods are separated away from each other by magnetic repulsion. Therefore, the healds supported by the carrier rods are prevented from contacting each other, so that they are arranged neatly in a row by the carrier rods.

However, healds made of a resin material and arranged in the above heald frame cannot be magnetized, so that any two adjacent healds in the heald frame cannot be separated.

The present invention is directed to providing a heald frame with healds made of a resin material wherein any two adjacent healds are separated by magnetic repulsion.

SUMMARY OF THE INVENTION

A heald frame has a frame stave, a carrier rod provided along the frame stave and a heald made of a resin material. A plurality of healds are supported by the carrier rod and arranged in a row. A magnet having N and S poles is provided in each heald and the healds are arranged so that the adjacent ends of any two adjacent magnets are of the same polarity.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

Figure 1:
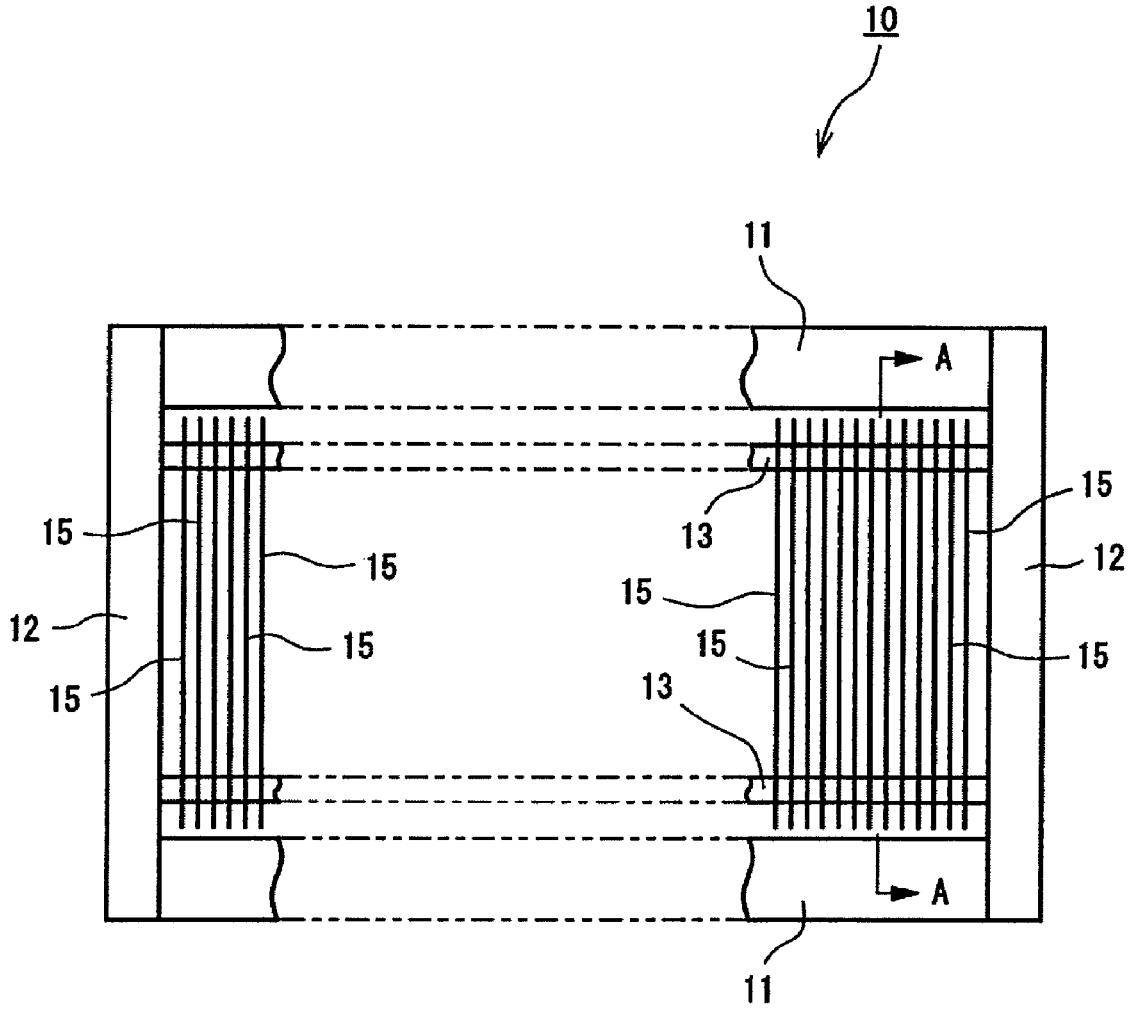
FIG. 1 is a front view of a heald frame according to a first embodiment of the present invention.

Embodiments according to the present invention will now be described with references to FIGS. 1 through 5. The following will describe the heald frame of the first embodiment according to the present invention. The heald frame 10 shown in FIG. 1 has a pair of upper and lower frame staves 11 and a pair of side stays 12 connecting the frame staves at the opposite ends thereof. The heald frame 10 further has therebetween a pair of carrier rods 13 extending adjacent to and parallel to the respective frame staves 11. The carrier rods 13 are fixed at the opposite ends thereof to the side stays 12. A plurality of healds 15 are supported by the carrier rods 13 and arranged in a row in longitudinal direction of the carrier rods 13.

Figure 2:
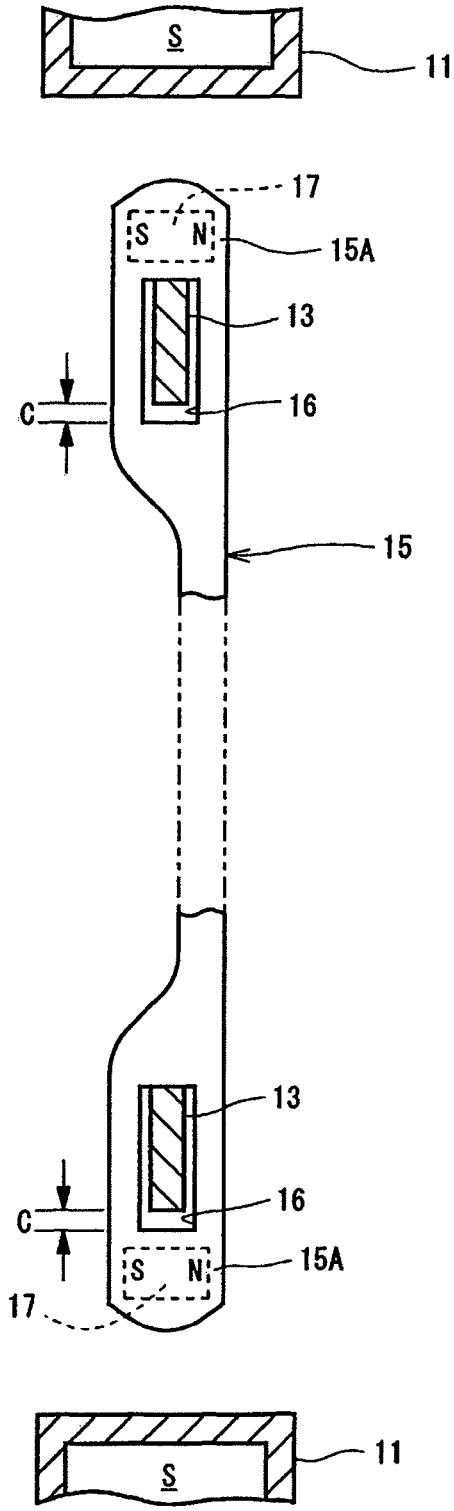
FIG. 2 is a view taken along the line A-A in FIG. 1.

The frame stave 11 is made of a hollow member having therein spaces S for reduction of weight, as shown in FIG. 2. The frame stave 11 has reinforcing ribs (not shown) formed so as to separate the spaces S. The upper and lower carrier rods 13 are of an identical structure having a rectangular cross section.

Each heald 15 has formed therethrough at the opposite ends thereof a rectangular elongated hole 16. The sectional area of the hole 16 is larger than that of the carrier rod 13 so that the carrier rod 13 is inserted through the hole 16. With the heald 15 supported by the carrier rods 13, one end of the heald 15 is the upper and the other end is the lower end. The heald 15 supported by the carrier rods 13 is slidable along the carrier rods 13. The carrier rod 13 and the heald 15 form a vertical clearance C therebetween, permitting the heald 15 to move a vertical distance corresponding to the clearance C. The heald 15 has formed therethrough an eye hole (not shown) at an intermediate position thereof for a warp yarn to be passed therethrough.

The heald 15 according to the present embodiment is made of a resin material such as Polyethylene Terephthalate (PET) and Polyacetal (POM) and has a thickness of about 0.4 mm. Rectangular and thin magnets 17 are buried in both end portions 15A of the heald 15 at a position outward of the holes 16, respectively. The magnet 17 is of a Neodymium magnet having N and S poles on the opposite ends thereof and has a thickness that is small enough for the magnet 17 to be buried in the heald 15. With the heald 15 supported by the carrier rods 13, the magnet 17 is disposed in the heald 15 in such an orientation that one of N and S poles of the magnet 17 faces the front and the other pole faces the rear of the heald 15, respectively. For example, with all the healds 15 supported by the carrier rods 13, the S pole and the N pole of the magnet 17 of each the heald 15 are located on the front side and the rear side of the heald frame 10, respectively. In other words, the healds 15 are arranged in such a way that the adjacent ends of any two adjacent magnets 17 are of the same polarity. It is noted that the rear side refers to the side where the warp yarn is supplied and the front side to the side where the woven cloth is taken up in the loom.

Figure 3:
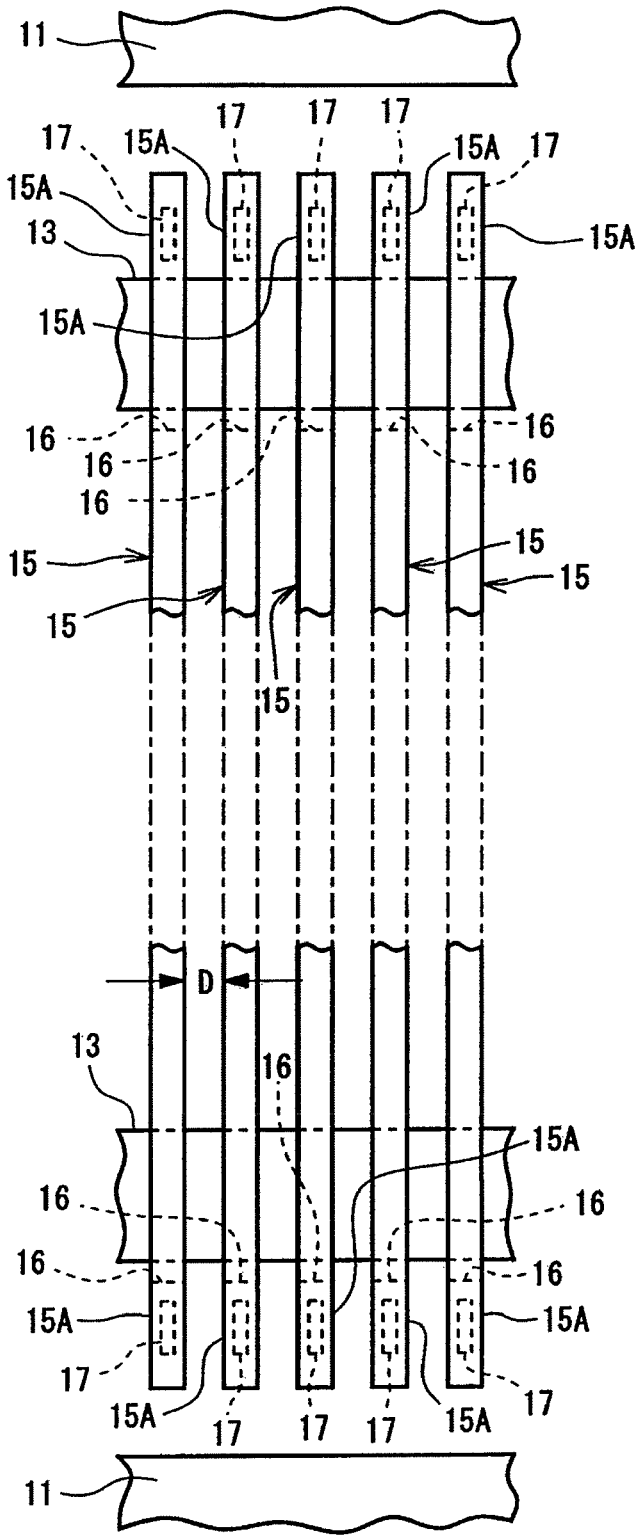
FIG. 3 is a partially enlarged front view of the heald frame according to the first embodiment.

Since the adjacent ends of any two adjacent magnets 17 are of the same polarity, the adjacent healds 15 are separated or spaced away from each other at a distance D by the magnetic repulsion as shown in FIG. 3. The healds 15 supported by the carrier rods 13 are arranged neatly in a row at the distance D along the carrier rods 13.

The magnet 17 buried in the opposite end portions 15A of the heald 15 should preferably have the same shape for production of the same magnetic repulsion between the healds 15. The healds 15 are spaced at the ends thereof at substantially the same distance, so that inclination of the heald 15 caused by the difference in the length of the spaced distance D is prevented.

The following advantageous effects are obtained according to the above-described first embodiment.

(1) With the healds 15 arranged in a row, the adjacent ends of any two adjacent magnets 17 buried in the healds 15 are of the same polarity, with the result that the adjacent healds 15 are separated away each other along the carrier rod 13 by magnetic repulsion of the magnets 17 acting on the healds 15. Thus, contact between the adjacent healds 15 made of a resin material can be prevented.

(2) Since the magnets 17 of the same shape are buried in the opposite end portions 15A of each heald 15, magnetic repulsion acting on the healds 15 is the same and, therefore, the distance D between any two adjacent healds 15 at the end portions 15A thereof is kept the same.

The following will describe a heald frame of an alternative embodiment according to the present invention. The alternative embodiment differs from the first embodiment in that the magnet 17 is not buried in the heald 15 but it is attached to the surface of the heald 15. This is the only difference between the first and alternative embodiments and the other elements and components are common. The same reference numerals and description of the first embodiment for the common elements and components are applicable to the alternative embodiment.

Figure 4:
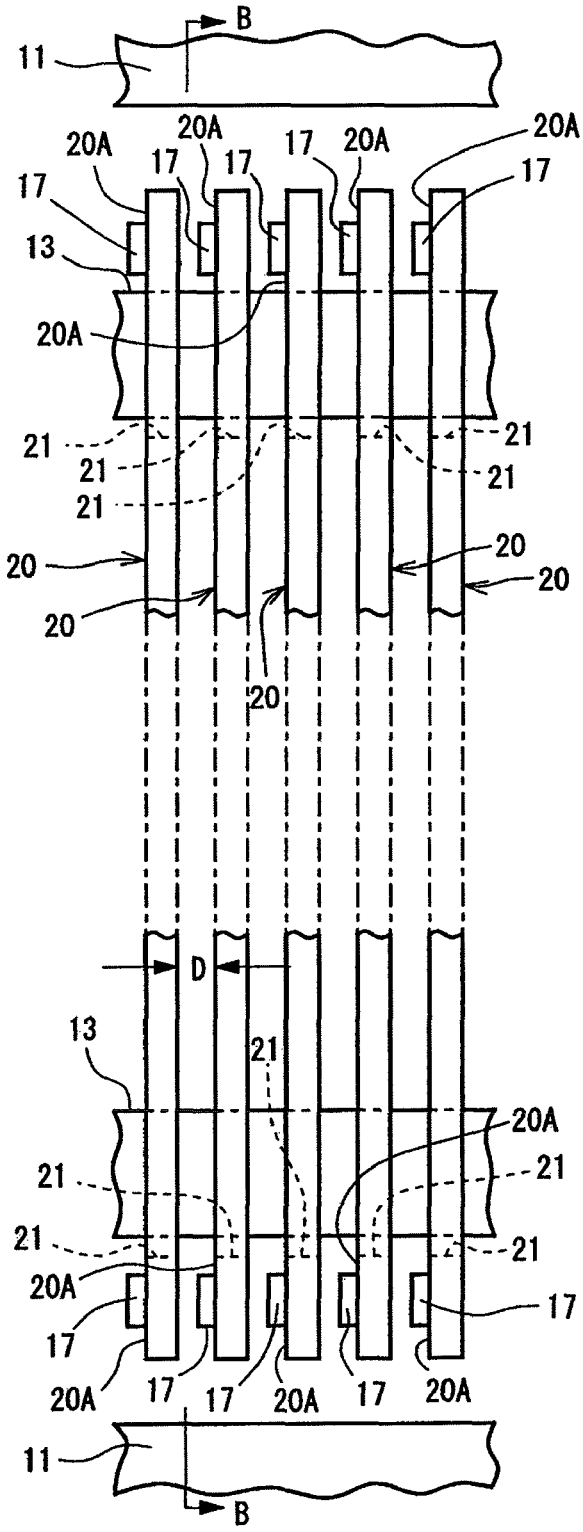
FIG. 4 is a partially enlarged front view of the heald frame according to an alternative embodiment.
Figure 5:
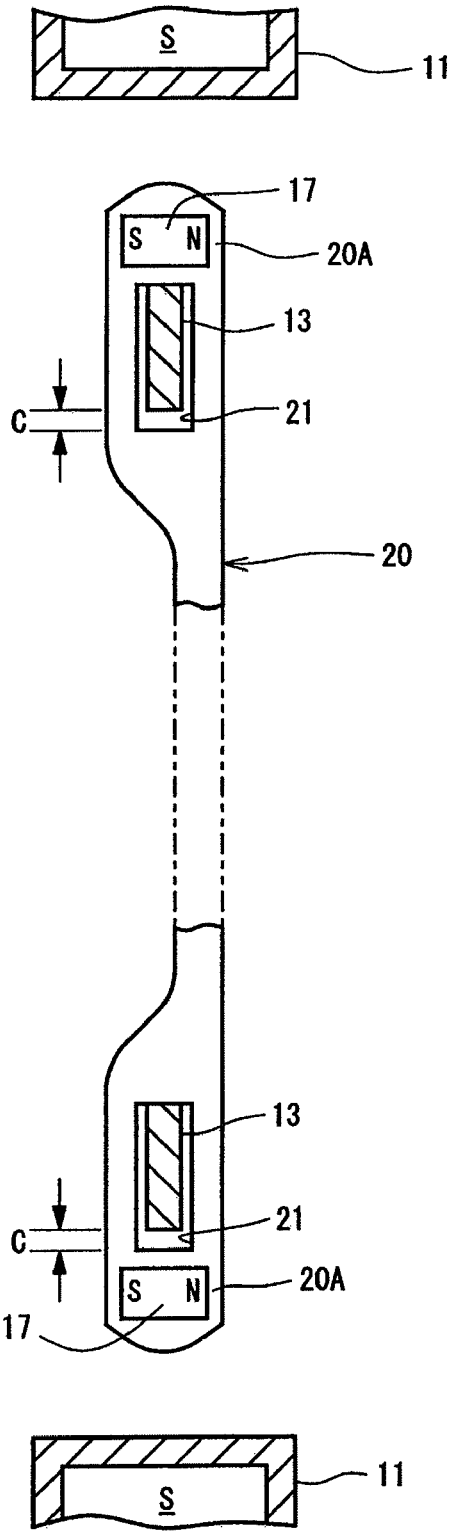
FIG. 5 is a view taken along the line B-B in FIG. 4.

Each heald 20 has formed therethrough at the opposite ends thereof rectangular elongated hole 21, as shown in FIGS. 4 and 5. The sectional area of the hole 21 is larger than that of the carrier rod 13 so that the carrier rod 13 is inserted through the hole 21. Rectangular and thin magnets 17 are attached to the surface of both end portions 20A of the heald 20 at a position outward of the holes 16, respectively. The magnet 17 is attached only to one of the opposite surfaces of each end portion 20A of the heald 20. The magnet 17 is of a Neodymium magnet and attached to the heald 20 by any suitable adhesive (not shown).

With the healds 20 supported by the carrier rods 13, S pole of each magnet 17 attached to the heald 20 is located on the front side of the heald frame and N pole of each magnet 17 is located on the rear side of the heald 20 as viewed from the surface of the heald 20 where the magnet 17 is attached as shown in FIG. 5. Therefore, when each heald 20 is supported by the carrier rod 13 so that each surface of the healds 20 where the magnet 17 is attached faces in the same direction, the S pole is located in the front side of all the heald 20 and the N pole is located in the rear side thereof. In such arrangement of the magnets 17, one surface of a heald 20 having a magnet 17 attached thereto faces a surface of its adjacent heald 20 having no magnet 17 attached thereto.

In this alternative embodiment, the magnetic force of the magnet 17 attached to the heald 20 penetrates the heald 20 and works together with the magnetic force of the other magnet 17 attached to the adjacent heald 20 thereby to generate the magnetic repulsion.

The magnetic repulsion produced between the adjacent healds 20 acts to separate the healds 20 away from each other at a spaced distance D as shown in FIG. 4.

In the alternative embodiment, it is easier to manufacture the heald 20 as compared with the first embodiment in which the magnet 17 is buried in the heald 20 because the magnet 17 is just attached to the surface of the heald 20 by adhesive. Moreover, the alternative embodiment is advantageous over the first embodiment in that the freedom in selecting a magnet 17 in terms of thickness is high because there is few restriction on the thickness of the magnet 17 relative to that of the heald 20.

The heald frame according to the above-described embodiments are to be considered as illustrative and not restrictive, and the invention is not to be limited to the above embodiments but may be modified within the scope of the below aspects.

The healds in the above embodiments are detachable from the carrier rods by disconnecting the carrier rods from the side stays of the heald frame. The present invention is not limited to such type of heald, but it may be applied to a riderless type heald.

The magnet is of a square-shaped thin plate in the above embodiments. However, as long as the magnet can be attached to or buried in the heald and also be disposed in such a polarity that either one of N and S poles is located on the front side of the heald frame and the other of the poles is located on the rear side, the magnet may take any shape.

The magnets are buried in or attached to the opposite ends of the heald in the above embodiments, but the magnets may be provided in other places than the heald ends.

The carrier rod has a rectangular cross section in the embodiments, but the cross section of the carrier rod is not limited to a rectangular shape, but it may be circular or oval. In such cases, the hole formed through the heald for receiving a carrier rod may have a similar shape of the cross section of the carrier rod.

The magnet is attached to one surface of the heald in the alternative embodiment, but the magnets may be attached to both surfaces of the heald depending on the thickness of the heald or the type of the magnet.

In the alternative embodiment, with the healds 15 supported by the carrier rods 13, one of the S and N poles of the magnet 17 of the heald 15 is located on the front side and the other on the rear side of the heald frame, respectively as viewed from one surface of the heald. Alternatively, a thin plate-type magnet having N and S poles on opposite surfaces thereof may be attached to or buried in the heald in such polarity that the same poles face each other between any two adjacent healds so that magnetic repulsion is created between the adjacent healds.

What is claimed is:

1. A heald frame comprising:

a frame stave;

a carrier rod provided along the frame stave; and a heald made of a resin material, wherein a plurality of healds are supported by the carrier rod and arranged in a row such that a warp yarn forming a woven cloth passes there-through, wherein a rectangular and thin magnet having N and S poles is provided in each heald and the healds are arranged so that the adjacent ends of any two adjacent magnets are of the same polarity, and wherein the magnet is disposed in the heald in such an orientation that one of N and S poles of the magnet faces the front and the other pole faces the rear of the heald frame, respectively.

2. The heald frame according to claim 1, wherein the magnet is buried in the heald.

3. The heald frame according to claim 1, wherein the magnet is attached to a surface of the heald.

4. The heald frame according to claim 1, wherein the heald has a hole at an end thereof so that the carrier rod is inserted through the hole, wherein the magnet is provided in end portion of the heald at a position outward of the hole.

5. The heald frame according to claim 4, wherein the magnets are provided in both end portions of the heald at a position outward of the holes.

6. The heald frame according to claim 1, wherein the resin material of the heald is either Polyethylene Terephthalate (PET) or Polyacetal (POM).

* * * * *